United States Patent [19]

Blake

[11] Patent Number: 4,880,130

[45] Date of Patent: Nov. 14, 1989

[54] FLEXIBLE, EXTRUDED, PROTECTIVE RIM

[76] Inventor: Peter J. Blake, P.O. Box 982, Bondsville, Mass. 01009

[21] Appl. No.: 222,570

[22] Filed: Jul. 21, 1988

[51] Int. Cl.[4] ..... B65D 25/00

[52] U.S. Cl. ..... 220/85 K; 220/DIG. 3

[58] Field of Search ..... 220/85 R, 85 K, 90.6, 220/DIG. 3

[56] References Cited

U.S. PATENT DOCUMENTS 3,587,700 6/1971 Mauer ..... 220/85 K X 3,792,498 2/1974 Klimboff et al. ..... 220/85 K X

FOREIGN PATENT DOCUMENTS 468711 7/1937 United Kingdom ..... 220/85 K

*Primary Examiner*—John Fox

*Attorney, Agent, or Firm*—Charles R. Fay

[57] ABSTRACT

An extruded plastic shape made to snap over the top of a barrel whose cover has been removed by means of suitable cutting devices, and containing an undercut to clear the outside bead of the container and an opposing undercut to clear the cut edge which is produced on the inside edge of the barrel, protecting people from injury sustained from said cut edge. This material could be available in coil form, fit over the barrel, then cut to length at the site.

15 Claims, 2 Drawing Sheets

FIG. 1
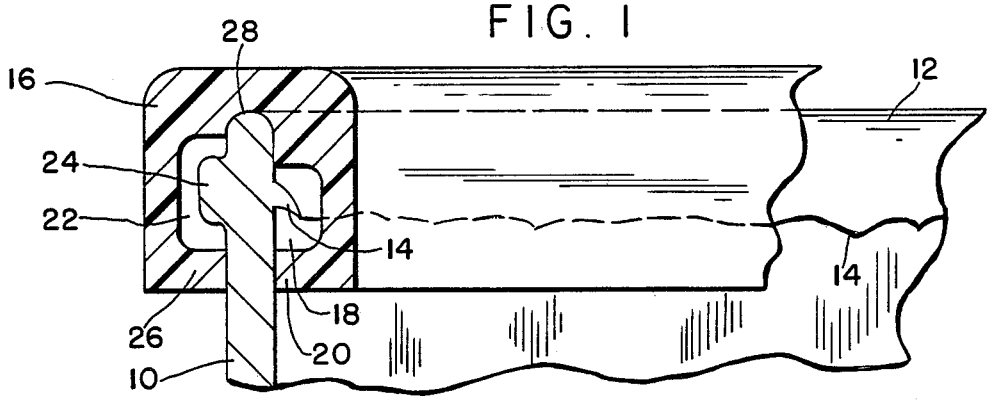
FIG. 2
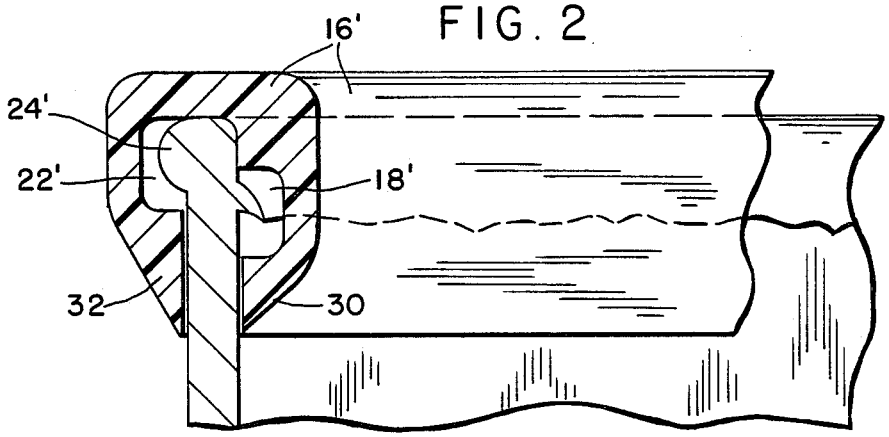
FIG. 3
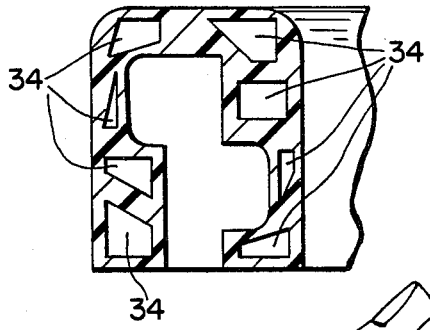
FIG. 4
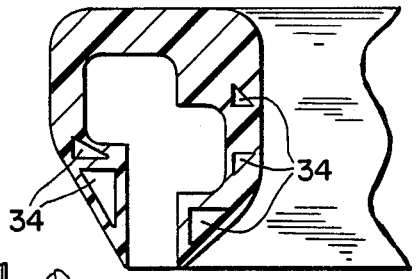
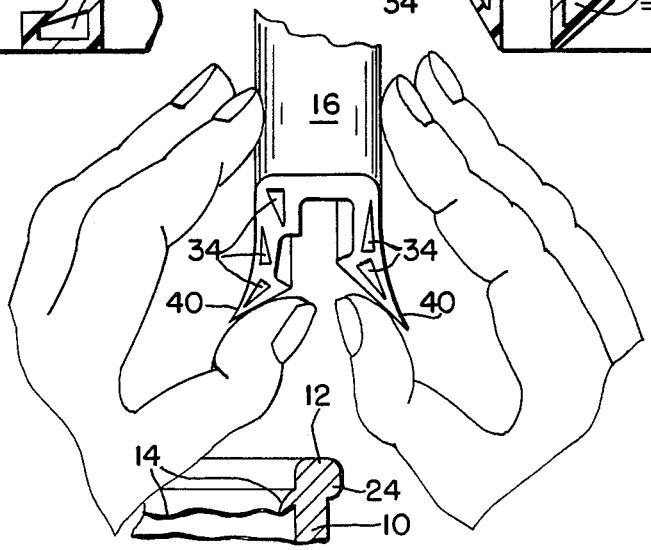
FIG. 5

FIG. 6
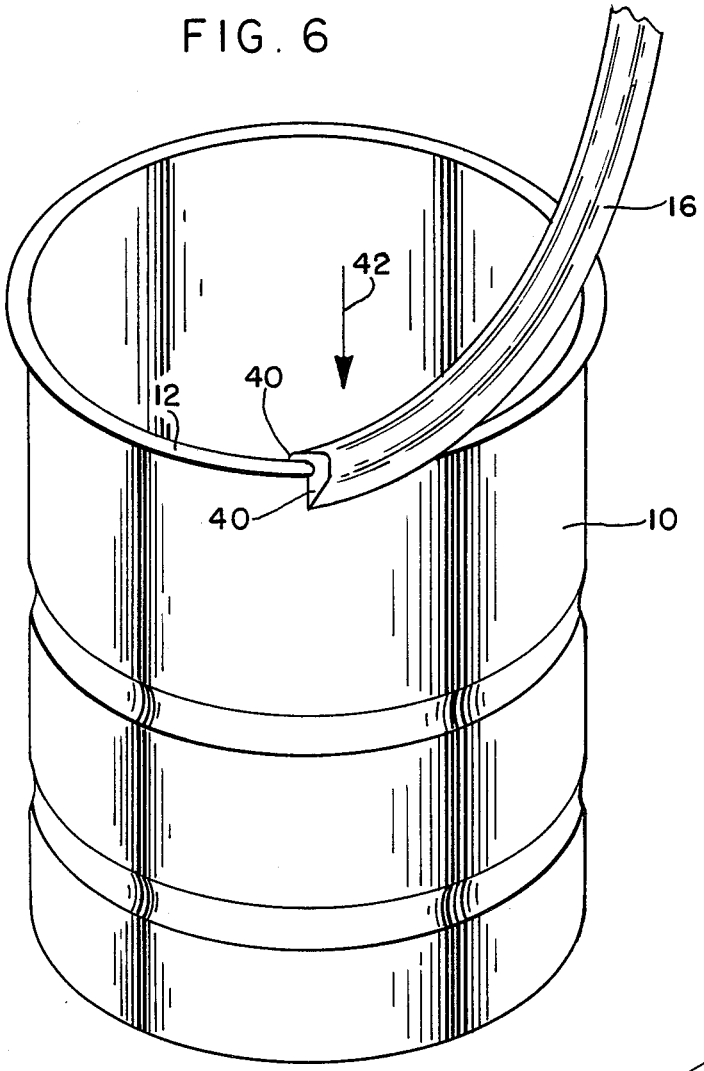
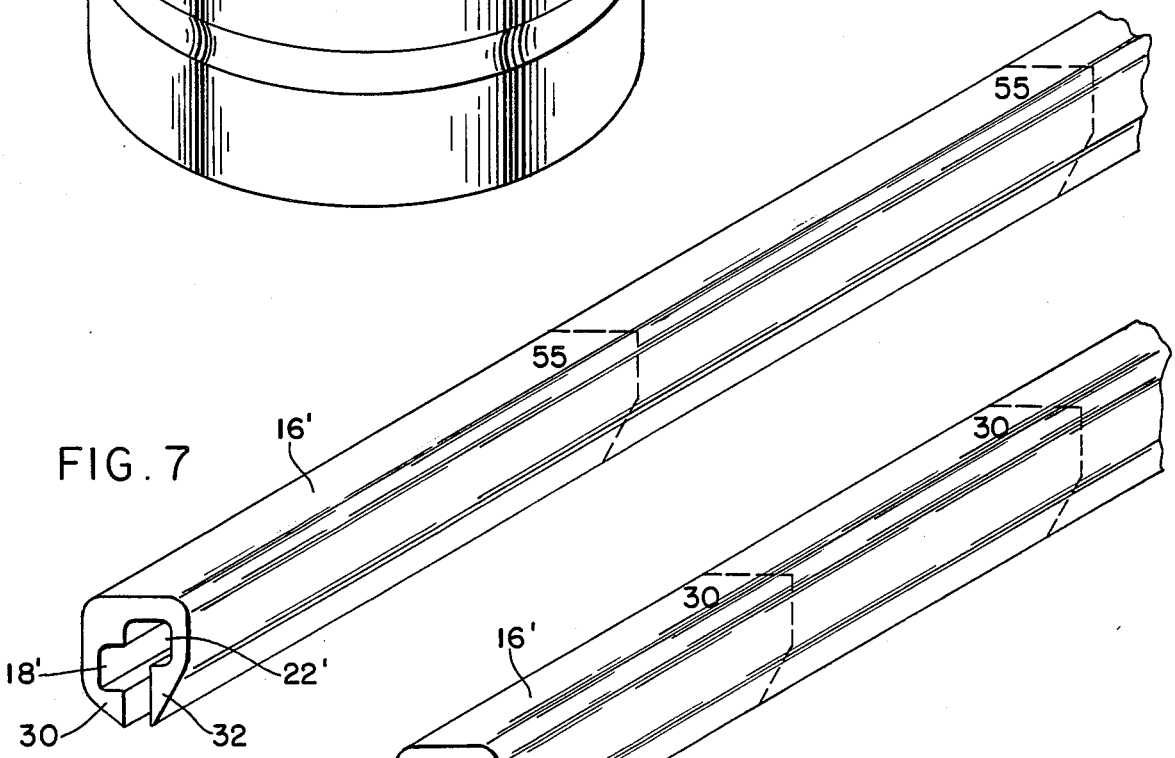
FIG. 7
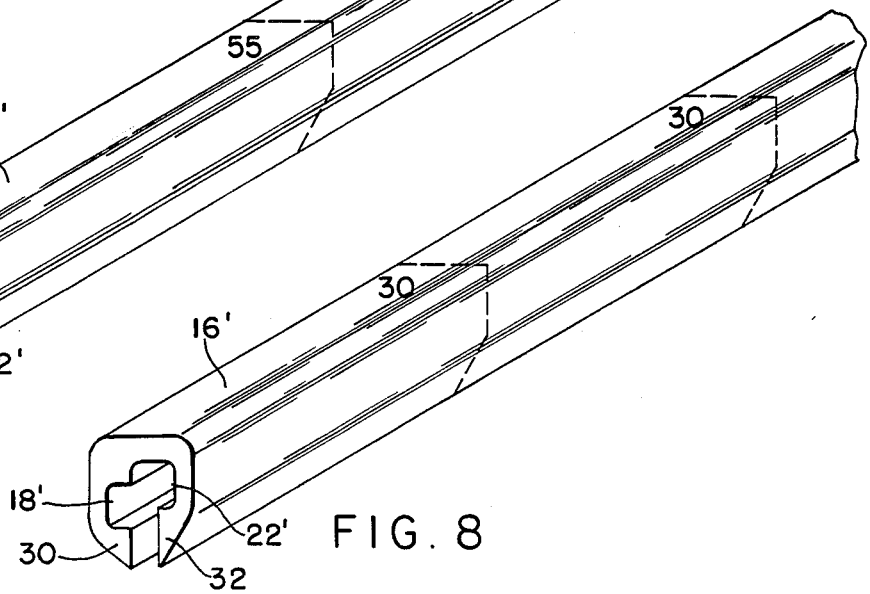
FIG. 8

FLEXIBLE, EXTRUDED, PROTECTIVE RIM

BACKGROUND OF THE INVENTION

Many open top containers used in industry, commercially, domestically, or by municipalities are made from discarded metal barrels and tanks of various sizes that once held oil, chemicals, or similar products. The covers are removed by means of chisel and hammer, pneumatic chisels, or commercial devices similar to can openers but of a larger scale. The removal procedure leaves a sharp edge that can severely cut a person who is moving the container, promoting lost production, infection and, in general, a threat to health. Gloves have been the traditional solution to this problem but are not always available or through carelessness, have not been used. The suspicious nature of the previous contents of these containers is also a threat to health. Some chemicals entering the bloodstream may have dire consequences on the individual who is injured by the sharp edge of the container.

A cure for these deficiencies would be to provide a protective cover of rubber or elastomeric plastic to cover the jagged edges of the rim; and it is the purpose of this invention to provide an inexpensive extruded covering that is easily and quickly snapped over the exposed barrel rim, and held thereon. The protective covering can be reused.

SUMMARY OF THE DISCLOSURE

An endless plastic extrusion of rubbery nature comprises a body of a section having sufficient material to protect hands and body from injury apt to occur in handling used, second-hand steel drums or barrels having had the barrel heads cut out. Care is usually not exercised in cutting out the heads, and the thickness of the extrusion is great enough to allow for easy handling. The extrusion is in the general form of an inverted U that is thrust down on the barrel rim, receiving the rim and held in place by the resiliency of the material, and jagged, uneven projections of the steel barrel at its rim and in the opening of the U shaped extrusion. No mechanical special fastening is needed. The material of the covering is recessed interiorly of the U to snap over and accommodate irregular projections at the rim of the coverless barrel, in many cases this helps to maintain the covering in place, but the covering has a kind of friction grip in any case. The extrusion may be cut to length and sold that way, or it may be spooled and cut off when needed.

BRIEF DESCRIPTION OF THE DRAWINGS

FIG. 1 is a view in elevation and section illustrating a form of the invention;

FIG. 2 is a view similar to FIG. 1 showing a modification;

FIGS. 3 and 4 are sectional views illustrating different forms of the invention in which the extrusions are provided with internal reliefs;

FIG. 5 is a view illustrating a way to start the application of the extrusion to the rim of a container;

FIG. 6 shows the extended protective rim during application thereof; and

FIGS. 7 and 8 are perspective views showing proposed markings on the extrusions for cutting off to size.

PREFERRED EMBODIMENT OF THE INVENTION

The material used in this invention is selected from plastic formulas of extrudable, flexible, tough characteristics and rubber or synthetic rubber could be used. The extrusion may be continuous and the resulting product reeled and sold in long lengths and cut to order, or of course, the extrusion can be cut at the factory into desired lengths and sold in bundles.

In FIG. 1, a barrel, drum, or other similar container 10 has an open rim 12, the previously knocked or cut out cover not being shown but usually leaving sharp, dangerous irregular lips or cutting edges like 14 that often damage hands or arms of the worker. The new protective rim 16 is the protective device that is applied to the rim 12 covering cutting edge 14 so that the container can be safely manhandled in further use thereof. This device or rim for the container, is generally U-shaped in inverted form and has an undercut 18 at the inside aspect to accommodate the cutting edge 14 and render it safe. The rim 16 then extends outwardly to the left as at 20 in FIG. 1 to contact or substantially contact the inside of container 10, to aid in positioning the protective rim on the container, barrel, etc.

There may also be an outside undercut 22 to accommodate an outer bead or lip 24 often found on drums and barrels, and this side of the protective rim then extends inwards to the right in FIG. 1 at 26 to complement its opposite member at 20. The extreme edge of the rim 12 snugly sets into a groove 28 at the general center of the bottom of the U-shaped, elongated, flexible extrusion. It is to be noted that the outside undercut 22 is a little larger than undercut 18 to better fit the usual conditions found in this area.

As shown in FIGS. 2 and 4, the edges of the protective rim 16' in the areas of 20 and 26 may be tapered down for ease and comfort, etc., as at 30 and 32. The undercuts 18' and 22' may be sized and positioned differently, especially where the lip or bead 24' is close to or at the edge of rim 12. In both cases, the protective rim is flexible, extruded, etc., and may have generally endless or concomitant voids or reliefs 34 of various sections to render the product of less weight, material, etc., and with greater flexibility and easier handling, see FIGS. 3 and 4.

FIG. 5 illustrates a way of starting the protective rim 16 onto the rim 12 of the used drum or barrel 10. The oprator spreads lips 40 apart and grasping the spread sides of the protective rim, draws it down onto the rim 12, to a position consistent with FIGS. 1 or 2, and then exerts pressure downwardly at about the point indicated by arrow 42 in FIG. 6, to gradually seat the entire protective rim 16 onto and over the drum rim 12 and sharp edge 14. The length of protective rim 16 has previously been determined, and if rim 16 is continuous, as on a reel, it is cut off to length prior to the above application.

FIGS. 7 and 8 merely show how the extrusions can be marked to cut - cut lines for 55 gallon drums, e.g., FIG. 7, and actual lengths, as for 30 gallon barrels or durms, see FIG. 8. Both markings for 55 or 30 gallon drums may appear on opposite sides of the rim, with their designator. Of course, these lengths and others, could be pre-cut and the lengths stored in bundles or bins.

Various other things may be utilized such as stabilizing the material against the adverse effects of ultraviolet light, low temperatures, etc., as well as hard usage, impacts, etc. Suitabel fillers may be added to reduce thermal expansion.

I claim:

1. A protective device for the rims of containers that present dangerous or jagged edges to a handler, said device comprising a flexible length of relatively soft material of uniform section, said length of material having a relatively smooth upper surface and outer side surfaces, and a downwardly open upwardly extending slot at its lower surface for reception of the dangerous (rim) edge of the container, said slot having outer edges, and interior recesses extending laterally from the slot, the outer edges of the slot being closer together than the lateral extent of the (two) recesses, and the recesses being larger than the dangerous edge.

2. The device of claim 1 wherein the interior recesses extend the length of the entire protective device.

3. The device of claim 2 including voids in the material for the length thereof.

4. The device of claim 1 wherein the slot terminates in inwardly directed portions that tend to contact the container below the dangerous edges.

5. The device of claim 4 wherein the inwardly directed portions are tapered externally down the slot.

6. The device of claim 1 wherein the interior recesses are an outer recess and an inner recess, the inner recess accommodating the dangerous edge of the container, and the outer recess accommodating any bead or lip, the outer recess being larger than the bead or lip.

7. The device of claim 6 wherein the recesses face each other.

8. The device of claim 7 wherein the outer recess is closer to the bottom of the slot than is the inner recess.

9. A protective rim for application to the cut edge of (a) an opening in a drum (to protect the hands of the handler), said rim comprising an elongated, extruded, flexible length of semi-soft plastic, said rim being in the general shape in section of an inverted U, the shape accommodating the edge of the drum and extending down past any cut edge thereon adjacent the opening thereof, the protective rim being applied by manually snapping it down over the drum edge, said protective rim having a lengthwise continuous recess (at the inside of its U-shape) to accommodate the cut edge, the recess being of greater lateral dimension than the size of the cut edge, to accommodate various cut edges.

10. THe rim of claim 9 wherein the exterior of the U-shaped rim is tapered down. U-shaped rim.

11. The rim of claim 9 including a second elongated recess facing the first named recess.

12. The rim of claim 11 wherein the second recess is closer to th closed end of the U-shaped rim than the first named recess.

13. The rim of claim 9 including elongated continuous voids in the extruded material of the rim.

14. The rim of claim 9 including printing on the rim indicating points of separation into separate shorter lengths for drums of different capacities.

15. The combination of a cylindrical container with a circular open top and the remainder of a metal top that has been rought cut out of the container leaving a non-uniform jagged edge portion adherent to the circular open top, said jagged edge presenting a hazard, and a protective cover for temporary use to cover said jagged edge and render it non-hazardous, wherein said protective cover is pliable, elongated, and narrow so as to cover the open top and the jagged edge, a downwardly open upwardly extending slot therein from end to end thereof for reception of the open top, and interior recesses in the slot, said recesses being co-extensive with the cover and extending laterally into the material of the cover, there being two facing recesses, one rear extending outwardly from the slot relative to the open top of the container and the other recess extending oppositely, the outwardly extending recess being large enough to accommodate any possible bead on the open top, and the other recess being oversize with respect to the said jagged edge to accommodate and cover any such jagged edge in spaced relation thereto, whereby the jagged edge is covered and protects a handler of the container.

* * * * *